US006873229B2

(12) United States Patent
Pike

(10) Patent No.: US 6,873,229 B2
(45) Date of Patent: Mar. 29, 2005

(54) IN LINE STRUCTURE FOR AGITATION OF FLUID DIELECTRICS IN RF DEVICES

(75) Inventor: Randy T. Pike, Grant, FL (US)

(73) Assignee: Harris Corporation, Melbourne, FL (US)

( * ) Notice: Subject to any disclaimer, the term of this patent is extended or adjusted under 35 U.S.C. 154(b) by 36 days.

(21) Appl. No.: 10/441,743

(22) Filed: May 19, 2003

(65) Prior Publication Data

US 2004/0233023 A1 Nov. 25, 2004

(51) Int. Cl.[7] ..... H01P 3/08

(52) U.S. Cl. ..... 333/246; 333/133; 333/193

(58) Field of Search ..... 333/246, 133, 333/193, 132, 187, 204

(56) References Cited

U.S. PATENT DOCUMENTS

| | | | | |
|---|---|---|---|---|
| 4,851,681 | A | 7/1989 | DePauli | |
| 5,140,498 | A | 8/1992 | Radford et al. | |
| 6,065,195 | A | 5/2000 | Chatterjee et al. | |
| 6,447,106 | B1 | 9/2002 | Watanabe et al. | |
| 6,501,625 | B1 | 12/2002 | Boismier et al. | |
| 6,531,933 | B2 * | 3/2003 | Miyamoto et al. | 333/133 |
| 6,570,469 | B2 * | 5/2003 | Yamada et al. | 333/193 |
| 2004/0155727 | A1 * | 8/2004 | Snyder et al. | |

OTHER PUBLICATIONS

U.S. Appl. No. 10/369,436, filed Feb. 18, 2003, Rawnick et al.
U.S. Appl. No. 10/387,208, filed Mar. 11, 2003, Rawnick et al.
U.S. Appl. No. 10/330,755, filed Dec. 27, 2002, Rawnick et al.
U.S. Appl. No. 10/330,754, filed Dec. 27, 2002, Rawnick et al.
U.S. Appl. No. 10/300,456, filed Nov. 19, 2002, Rawnick et al.
U.S. Appl. No. 10/361,548, filed Feb. 10, 2003, Rawnick et al.
U.S. Appl. No. 10/387,209, filed Mar. 11, 2003, Rawnick et al.
U.S. Appl. No. 10/439,094, filed May 15, 2003, Rawnick et al.
U.S. Appl. No. 10/387,194, filed Mar. 11, 2003, Brown et al.
U.S. Appl. No. 10/438,435, filed May 15, 2003, Brown et al.
U.S. Appl. No. 10/414,696, filed Apr. 16, 2003, Brown et al.
U.S. Appl. No. 10/637,027, filed Aug. 7, 2003, Brown et al.
U.S. Appl. No. 10/414,650, filed Apr. 16, 2003, Brown et al.
U.S. Appl. No. 10/635,629, filed Aug. 6, 2003, Brown et al.
U.S. Appl. No. 10/459,067, filed Jun. 11, 2003, Brown et al.
U.S. Appl. No. 10/438,436, filed May 15, 2003, Rawnick et al.
U.S. Appl. No. 10/626,090, filed Jul. 24, 2003, Brown et al.
U.S. Appl. No. 10/635,582, filed Aug. 6, 2003, Rawnick et al.
U.S. Appl. No. 10/632,632, filed Aug. 1,2003, Rawnick et al.
U.S. Appl. No. 10/614,149, filed Jul. 7, 2003, Brown et al.
U.S. Appl. No. 10/634,219, filed Aug. 5, 2003, Rawnick et al.

(List continued on next page.)

*Primary Examiner*—Michael Tokar
*Assistant Examiner*—Lam T. Mai
(74) *Attorney, Agent, or Firm*—Sacco & Associates, PA

(57) ABSTRACT

An RF device includes a substrate (502) formed of a low temperature co-fired ceramic (LTCC). A cavity structure, such as a conduit (508) can be provided within the substrate with at least one fluid dielectric contained within the cavity structure. The RF device can also include a piezoelectric structure (504) for concurrently applying agitation force to the fluid dielectric in at least two opposing directions. The opposing directions can include substantially all directions normal to an interior surface defining a fluid conduit over a selected length of the fluid conduit.

30 Claims, 5 Drawing Sheets

OTHER PUBLICATIONS

U.S. Appl. No. 10/458,859, filed Jun. 11, 2003, Rawnick et al.
U.S. Appl. No. 10/624,378, filed Jul. 22, 2003, Brown et al.
U.S. Appl. No. 10/438,433, filed May 15, 2003, Rawnick et al.
U.S. Appl. No. 10/460,947, filed Jun. 13, 2003, Rawnick et al.
U.S. Appl. No. 10/421,352, filed Apr. 23, 2003, Rawnick et al.
U.S. Appl. No. 10/409,261, filed Apr. 8, 2003, Pike.
U.S. Appl. No. 10/628,846, filed Jul. 28, 2003, Pike et al.
U.S. Appl. No. 10/448,973, filed May 30, 2003, Delgado et al.
U.S. Appl. No. 10/300,455, filed Nov. 19, 2002, Brown et al.
U.S. Appl. No. 10/409,261, filed Apr. 8, 2003, Pike.
U.S. Appl. No. 10/628,846, filed Jul. 28, 2003, Pike et al.

* cited by examiner

IN LINE STRUCTURE FOR AGITATION OF FLUID DIELECTRICS IN RF DEVICES

BACKGROUND OF THE INVENTION

1. Statement of the Technical Field

The inventive arrangements relate generally to RF devices and more particularly to structures and systems for preventing degradation of fluid dielectrics that are used in RF devices.

2. Description of the Related Art

Glass ceramic substrates calcined at 850° C. to 1,000° C. are commonly referred to as low-temperature co-fired ceramics (LTCC). This class of materials have a number of advantages that make them especially useful as substrates for RF systems. For example, low temperature 951 co-fire Green Tape™ from Dupont® is Au and Ag compatible, and it has a thermal coefficient of expansion (TCE) and relative strength that are suitable for many applications. The material is available in thicknesses ranging from 114 $\mu$m to 254 $\mu$m and is designed for use as an insulating layer in hybrid circuits, multi-chip modules, single chip packages, and ceramic printed wire boards, including RF circuit boards. Similar products are available from other manufacturers.

LTCC substrate systems commonly combine many thin layers of ceramic and conductors. The individual layers are typically formed from a ceramic/glass frit that can be held together with a binder and formed into a sheet. The sheet is usually delivered in a roll in an unfired or "green" state. Hence, the common reference to such material as "green tape". Conductors can be screened onto the layers of tape to form RF circuit elements antenna elements and transmission lines. Two or more layers of the same type of tape is then fired in an oven. The firing process shrinks all of the dimensions of the raw part. Accordingly, it is highly important that the material layers all shrink in a precise, predetermined way that will provide consistent results from one module to the next.

Recent interest in fluid dielectric materials suggest the use of LTCC as a substrate because of its known resistance to chemical attack from a wide range of fluids. The material also has superior properties of wetability and absorption as compared to other types of solid dielectric material. These factors, plus LTCC's proven suitability for manufacturing miniaturized RF circuits, make it a natural choice for use in RF devices incorporating fluid dielectrics.

Still, the use of fluid dielectrics raises new potential problems. For example, fluid dielectrics can suffer degradation from a variety of factors. For example, the degradation can occur due to temperature variations, micro-gravity, phase separation, particulate settling and orientation, ionic migration, dendrite growth, and other intrinsic molecular separation phenomena. Some of these problems are less likely to occur in dynamic systems. However, even in the case of dynamic systems, fluids can separate due to particle fallout, particle separation, sedimentation, eddy effects and so on. These kinds of fluid degradations will effect the overall electrical characteristics of the fluid dielectric, regardless of whether the fluid is a dielectric suspension, dielectric agglomerate, a dielectrically loaded fluid, or a polymer blend.

In order to overcome the foregoing limitations, RF systems that take advantage of fluid dielectrics should include agitation systems for proper maintenance of the fluid dielectric. However, conventional agitations systems can cause damage to the fluid dielectric by introducing shear stresses. They can also have the undesired effect of consuming the limited space available on circuit boards. More advanced systems can potentially avoid some of the problems associated with shear stresses but can in some instances produce less effective mixing.

SUMMARY OF THE INVENTION

The invention concerns a method for preventing degradation of a fluid dielectric in an RF device. The method can include the steps of forming a substrate of the RF device from a low temperature co-fired ceramic (LTCC); and concurrently agitating the fluid dielectric from at least two opposing directions by exciting a piezoelectric material.

According to one aspect of the invention, the opposing directions can include substantially all directions normal to an interior surface defining a fluid conduit over a selected length of a fluid conduit. The piezoelectric material can be positioned in direct contact with the fluid dielectric or can be positioned behind a membrane.

The agitating step can advantageously be performed within a conduit portion of the substrate so as to avoid the need for a separate agitation chamber. Also, the agitating step can be performed at a location where non-Newtonian fluid dynamics are anticipated or at a location where a change in a direction of dielectric fluid flow is anticipated.

The method can include the step of selecting the piezoelectric material to include lead zirconate titanate (PZT) and bonding the PZT to the substrate. In that case, the bonding step can include positioning the PZT in contact with the substrate and co-firing the substrate together with the PZT. The PZT can also be doped to enhance bonding with the substrate. For example, the PZT can be doped with calcium, lead, zirconium, oxygen, titanium, or a rare earth element selected from the group consisting of Ruthenium, Osmium, Rhenium, Halfnium, Tantalum, and Germanium. The doping level can be chosen to be in the range from between about 0.5 to 18 percent weight, with a doping level of up to about 10% being presently preferred. The method can also include forming at least one electrical contact in the substrate coupled to the PZT for applying an exciter voltage.

According to an another aspect, the invention can include an RF device comprising a substrate formed of a low temperature co-fired ceramic (LTCC). A cavity structure can be provided within the substrate with at least one fluid dielectric contained within the cavity structure. The RF device can also include a piezoelectric structure for concurrently applying agitation force to the fluid dielectric in at least two opposing directions. The opposing directions can include substantially all directions normal to an interior surface defining a fluid conduit over a selected length of the fluid conduit.

The piezoelectric structure can be advantageously positioned at a location where non-Newtonian fluid dynamics are anticipated to occur within the cavity structure, or at a location where a change in a direction of fluid dielectric flow is anticipated. The piezoelectric structure can be comprised of lead zirconate titanate (PZT) bonded to the substrate as described above, wherein the PZT is doped to enhance embedded interstitial bonding with the substrate. For example, the PZT can be doped with calcium, lead, zirconium, oxygen, titanium, or a rare earth element selected from the group consisting of Ruthenium, Osmium, Rhenium, Halfnium, Tantalum, and Germanium. The RF device can also include at least one electrical contact formed in the substrate and coupled to the PZT for applying an exciter voltage.

DETAILED DESCRIPTION OF THE PREFERRED EMBODIMENTS

Figure 1:
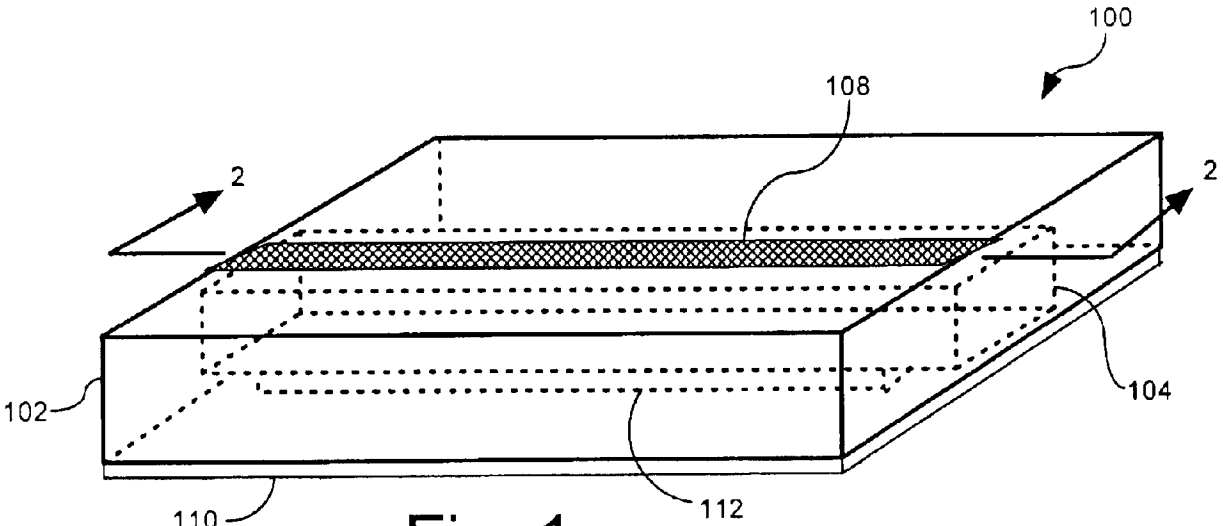
FIG. 1 is a perspective view of an RF device that is useful for understanding the present invention.

An RF device 100 that incorporates a fluid dielectric is illustrated in FIG. 1. The RF device 100 can include any type of RF circuit or component that advantageously makes use of at least one type of fluid dielectric to enhance performance or aid in controlling an operating parameter of the device. In FIG. 1, the RF circuitry is illustrated as including an RF transmission line component 108. However, the invention is not so limited. For example, the RF componentry can include, without limitation, antenna elements, matching sections, delay lines, beam steering elements, tunable transmission lines, stubs and filters, variable attenuators, cavity structures, and any other type of RF components that can benefit from the use of fluid dielectrics.

The RF device 100 also includes one or more cavity structures 104 formed in a substrate 102. The cavity structure 104 can be provided for constraining or transporting a fluid dielectric 106 within a defined region of the substrate 102 for advantageously utilizing the fluid dielectric 106 in the RF device. For example, the cavity structure 104 can define a fluid reservoir for storing fluid dielectric 106 when it is not in use. Alternatively, the cavity structure 104 can be a portion of a conduit used for transporting the fluid dielectric 106 from one portion of the substrate to another. Further, the cavity structure can be provided for constraining the fluid dielectric 106 in a predetermined region that is directly coupled to an RF element. For example, in FIG. 1, the cavity structure 104 is positioned generally adjacent to the transmission line 108 so that the electrical properties of the fluid dielectric can directly influence the operational characteristics of the transmission line element.

In some instances it can also be desirable to include a conductive ground plane 110 on at least one side of the substrate 102. For example, the ground plane 110 can be used in those instances where the RF circuitry includes microstrip circuit elements such as transmission line 108. The conductive ground plane 110 can also be used for shielding components from exposure to RF and for a wide variety of other purposes. The conductive metal ground plane can be formed of a conductive metal that is compatible with the substrate 102.

The substrate 102 can be formed of a ceramic material. Any of a wide variety of ceramics can be used for this purpose. However, according to a preferred embodiment, the substrate can be formed of a glass ceramic material fired at 850° C. to 1,000° C. Such materials are commonly referred to as low-temperature co-fired ceramics (LTCC).

Commercially available LTCC materials are commonly offered in thin sheets or tapes that can be stacked in multiple layers to create completed substrates. For example, low temperature 951 co-fire Green Tape™ from Dupont™ may be used for this purpose. The 951 co-fire Green Tape™ is Au and Ag compatible, has acceptable mechanical properties with regard to thermal coefficient of expansion (TCE), and relative strength. It is available in thicknesses ranging from 114 $\mu$m to 254 $\mu$m. Other similar types of systems include a material known as CT2000 from W. C. Heraeus GmbH, and A6S type LTCC from Ferro Electronic Materials of Vista, Calif. Any of these materials, as well as a variety of other LTCC materials with varying electrical properties can be used.

Figure 2:
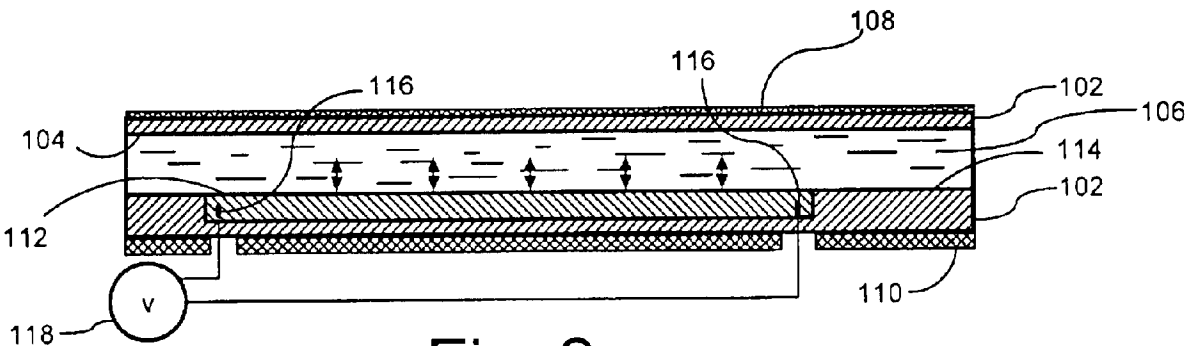
FIG. 2 is a cross-sectional view of the RF device in FIG. 1, taken along line 2—2.

According to a preferred embodiment, at least one agitation mechanism is provided for agitating the fluid dielectric 106. As illustrated in FIGS. 1 and 2, the agitation mechanism in the present invention is preferably a piezoelectric device 112. Use of piezoelectric agitation for fluid dielectrics in RF devices provides several distinct advantage as compared to other micro-agitation techniques.

One important advantage of piezoelectric agitation is the high degree of reliability of such devices due to the general absence of moving parts. Further, fluid dielectrics present special mixing problems that are not common to many other types of fluid mixing. Agitation systems that use manifolds, impellers, actuators, and certain other active systems can degrade fluid dielectric systems by inducing first, second, or higher order shear forces on the fluid. These shear forces can break inter- and intra-molecular bonds within the fluid dielectric 106, thereby causing a detrimental effect on the electrical performance of the fluid. Piezoelectric agitation is more subtle, considerably reducing the potential for damage to the fluid dielectric. Finally, RF circuit devices for certain civilian, military and space-based, applications must be capable of operating in extreme environmental conditions. Piezoelectric systems can operate effectively over a wide range of temperatures and in microgravity conditions that may occur in these environments. For all these reasons, piezoelectric agitation is particularly well suited for maintaining fluid dielectric in RF devices as described herein.

Referring again to FIGS. 1 and 2, the piezoelectric device 112 is preferably positioned so that it forms a portion of the lining 114 of the cavity structure 104 in direct contact with the fluid dielectric 106. However, the invention is not limited in this regard and it is also possible to provide the piezoelectric device 112 disposed behind a membrane (not shown) so that it is not directly exposed to the fluid dielectric 106. The membrane could be formed of a thin layer of LTCC or some other material.

Electrical contacts 116 are preferably formed in the substrate 102 and coupled to the piezoelectric device 112 for applying an exciter voltage from a source 118. When the exciter voltage is applied to the piezoelectric device 112, the piezoelectric device will be induced to mechanically deform in the conventional manner of piezoelectric materials.

Despite the advantages offered by making use of piezoelectric agitation techniques, the integration of piezoelectric materials into an LTCC substrate of an RF device presents certain problems. More particularly, a piezoelectric device for use in such applications should be formed of a material that can be chemically bonded to the LTCC substrate and should have physical properties that are compatible with the LTCC high temperature co-firing process.

LTCC is typically a composition of calcium, potassium, titanium, magnesium and oxygen. The precise formulation depends upon the commercial source. By comparison, most piezoelectric materials are not compatible with LTCC because they are polymeric based compositions that will thermally degrade during the co-firing process.

Many crystalline materials exhibit piezoelectric behavior. However, they do not generally exhibit the effect strongly enough to be used in the present invention. Materials that do exhibit the piezoelectric effect strongly include quartz, Rochelle salt, barium titanate, and polyvinylidene flouride (a polymer film). However, these materials are not chemically compatible with the LTCC in a way that will facilitate interstitial bonding. They also have physical properties that are not compatible with LTCC firing processes. Accordingly, these materials are unsuitable for use in LTCC based applications. According to a preferred embodiment, the piezoelectric device 112 can be comprised of a known class of piezoelectric materials comprised of lead zirconate titanate ($Pb(Zr_{0.5}Ti_{0.5})O_3$, or PZT). These include, without limitation, PZT-2, PZT-4, PZT-4D, PZT-5A, PZT-5H, PZT-5J, PZT-7A, PZT-8. In general, PZT requires a driving voltage of 3 V DC, to produce a deformation amplitude of 126 nm (zero to peak harmonic response) at a resonance frequency peak of 304.35 kHz. It has a maximum Q value of 705. The composition of PZT can be expressed as $PbZr_{0.52}Ti_{0.48}O_3$. In general, PZT has physical properties that are remarkably well suited for integration in a substrate 102 formed of LTCC. This factor is very important from an integration standpoint. For example, the coefficient of thermal expansion (CTE) for PZT ranges from −3.5 to $11\times10^{-6}$/K depending on the element ratio. This range is compatible with LTCC from a processing standpoint. In this regard, those skilled in the art will readily appreciate that it is important to closely match the CTE of the piezoelectric material to that of the LTCC in order to prevent microcracking, stress/strain, and warpage in the LTCC stack-up.

Ordinary PZT will not generally be chemically compatible with the LTCC so as to form the desired ionic or covalent molecular bonds in the co-firing process. Therefore, in order to make the PZT more compatible with LTCC, it is preferable to performing a doping step that includes doping the PZT with one or more elements contained in the PZT. Since calcium is the most common element in LTCC it is preferred to dope with calcium to produce $PbZrPbZr_{0.52}Ti_{0.48}O_3xCa^{2+}$ (Calcium Doped). However, other elements contained in the LTCC could also be used as dopants including for example, lead, zirconium, oxygen, and titanium. Also, certain rare earth materials could be used for this purpose, as they are capable of having high oxidation states that can induce additional molecular bonds. Examples of rare earth element that might be selected could include Ruthenium, Osmium, Rhenium, Halfnium, Tantalum, or Germanium.

In any case, the dopant material can comprise between about 0.5 to 18 percent weight of the PZT. Excessive doping levels are preferably avoided as they can potentially lead to problems relating to interstitial cracking and degrade the harmonic response of the PZT. A properly doped PZT form can be positioned on a pre-fired LTCC substrate and the compositions can be co-fired together to form a single unit.

As shown by the arrows in FIG. 2, the actuation force (vector) generated by the PZT during agitation should be generated and localized on the PZT form. This force is then projected into the fluid dielectric with the force/harmonic force vector projected at an angle of about 90° relative to the lining 114 of the cavity structure 104. A DC bias voltage for the PZT can be applied at electrodes 116 as shown in FIG. 2. The bias voltage can drive the PZT to a resonant frequency around 304.35 kHz. The electrodes would preferably be on opposite ends of the slab as shown in FIG. 2.

Figure 3:
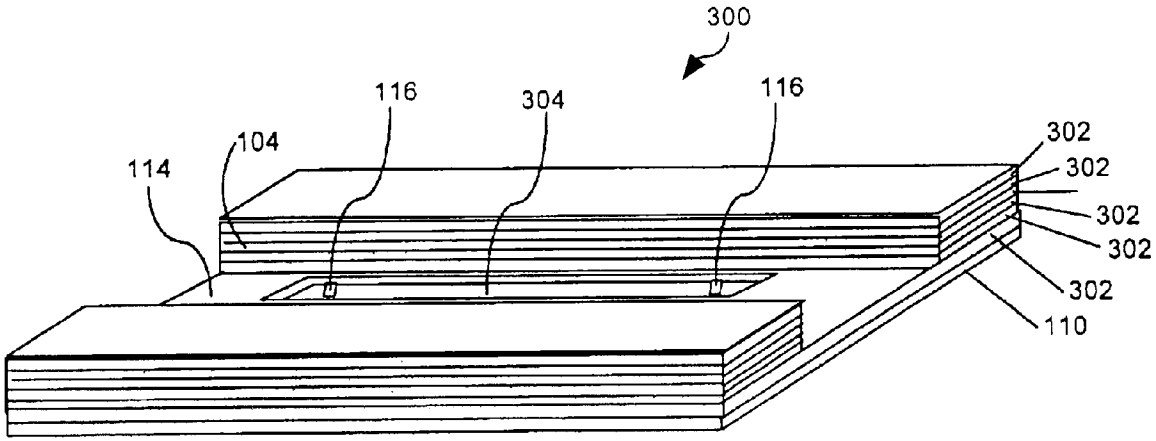
FIG. 3 is a perspective view of a ceramic material lay-up that is useful for understanding a process for fabricating the device in FIG. 1.

Referring now to FIG. 3, a process for manufacturing an RF device as described herein shall now be described in greater detail. As shown in FIG. 3, the process can begin by forming an LTCC stack 300 using conventional LTCC processing techniques. The stack 300 can be comprised of a plurality of layers of Green Tape®, or any other similar type LTCC material, so as to define a portion of the substrate 102. The stack 300 can also define at least a portion of the cavity structure 104 and can include a void 304. Once again, it should be noted that the shape, size and location of the cavity structure shown herein is merely by way of example and the invention is not intended to be limited to a cavity structure of any particular size, shape or location. Electrical contacts 116 as described above can be positioned within the void 304. Thereafter, the LTCC stack 300 can be fired in the conventional manner. LTCC initial firing temperature is typically up to about 500° C. to about 1110° C. depending on the particular design.

Figure 4:
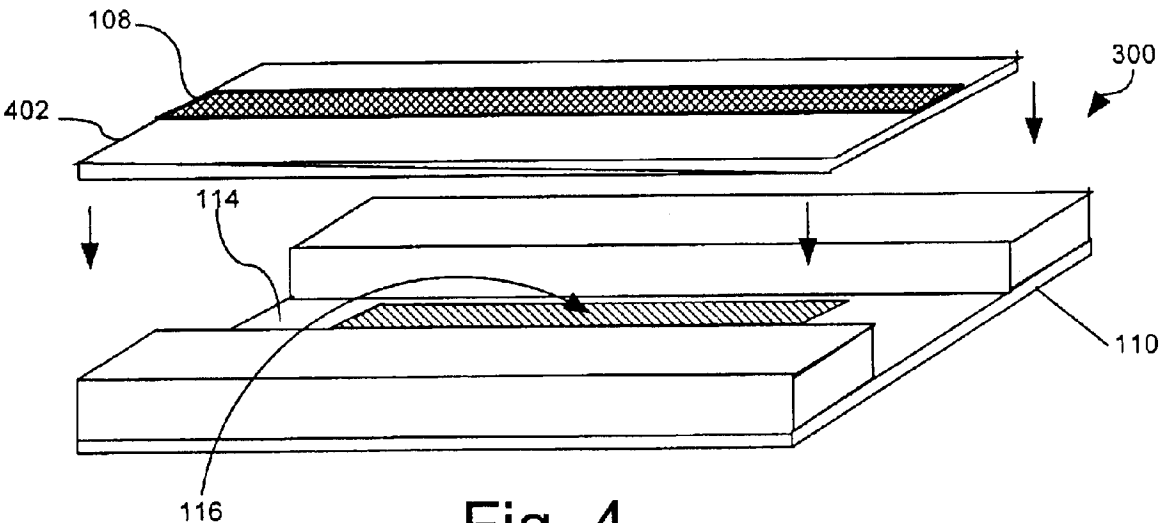
FIG. 4 is a perspective view of the ceramic material lay-up in FIG. 3 after firing, and showing the addition of the PZT and top layers.

After firing, a slurry or putty-like mixture of pre-doped PZT can be disposed in the void 304 as illustrated in FIG. 4. The part can subsequently be co-fired at a temperature of between about 500° C. to 800° C. to form the piezoelectric device 112. The remaining processing steps for completing the part, including the placement and firing of one or more ceramic layers 402, and the addition of RF circuit component(s) 108, can be performed in accordance with conventional LTCC fabrication techniques.

Finally, those skilled in the art will note that PZT ceramics must be poled to exhibit the piezo effect. During polarization the piece is heated (to allow alignment of the dipoles in the PZT and an electric field is applied. Conversely, a poled PZT will depole when heated above the maximum allowed operating temperature. PI HVPZTs have a Curie temperature of 300° C. and can be operated up to 150° C. (with P-702.10 high temperature option). LVPZTs show a Curie temperature of 150° C. and can be operated up to 80° C.

Figure 5:
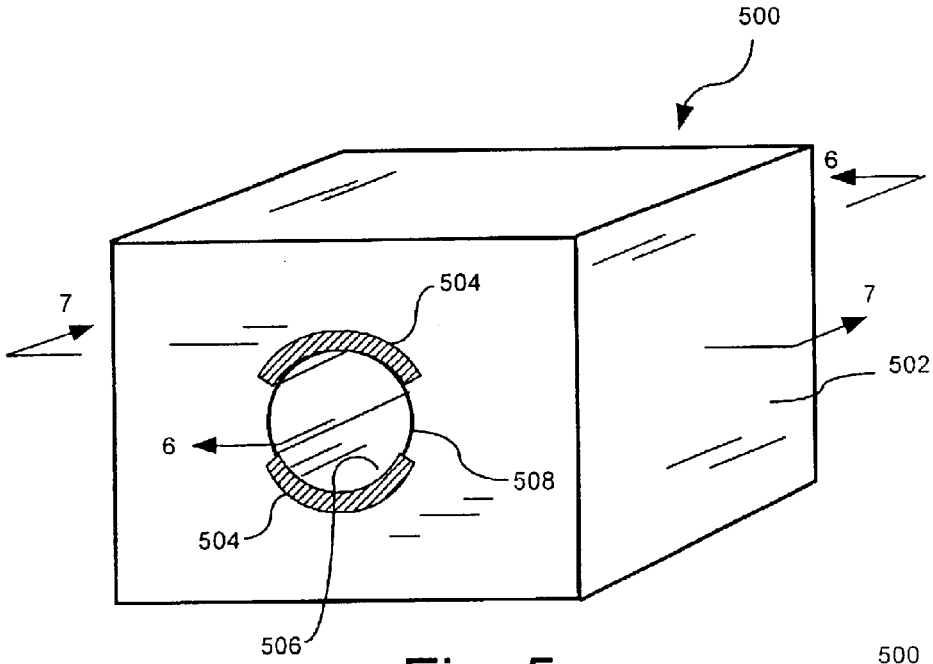
FIG. 5 is a perspective view of an alternative structure for an integrated mixing device.
Figure 6:
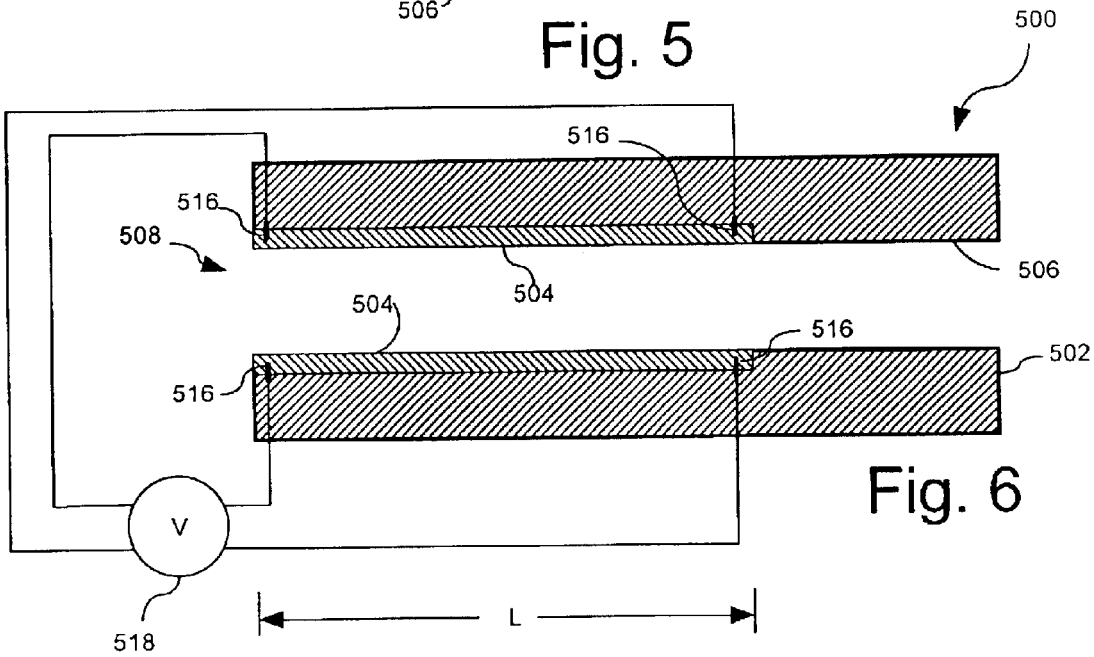
FIG. 6 is a cross-sectional view of the integrated mixing device of FIG. 5 taken along lines 6—6.
Figure 7:
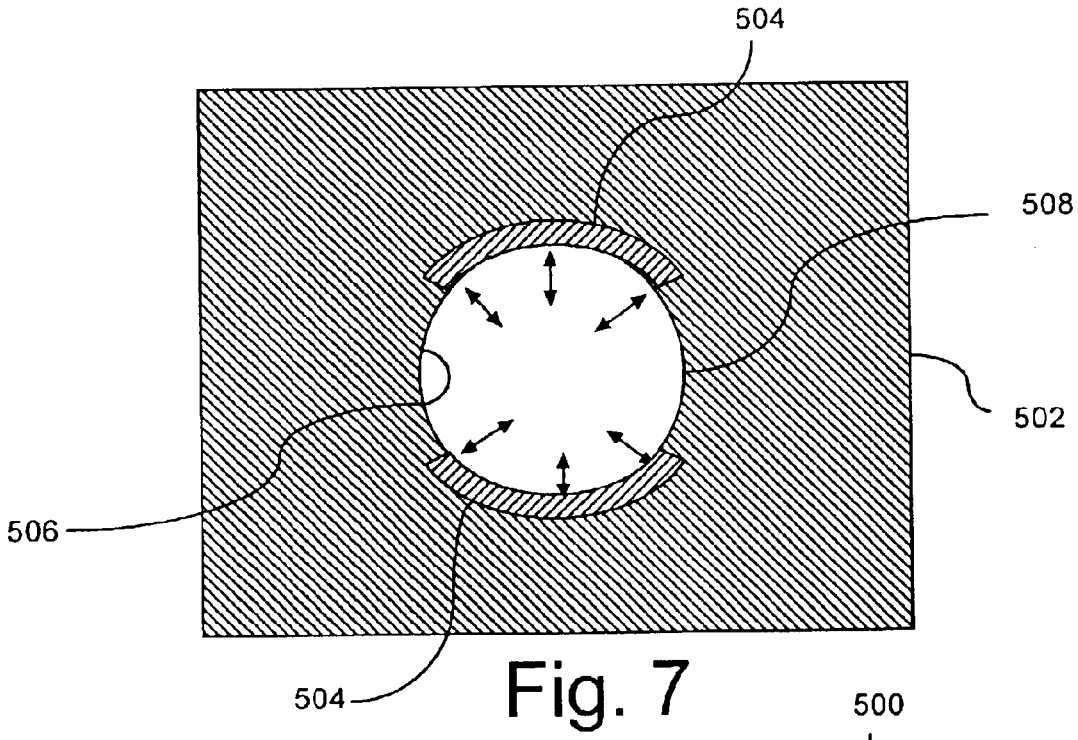
FIG. 7 is a cross-sectional view of the integrated mixing device of FIG. 5 taken along lines 7—7.

An alternative embodiment of the invention is illustrated in FIGS. 5–7. Referring to FIG. 5, a section 500 of an LTCC substrate 502 is illustrated that includes a fluid cavity which, in this case, is a fluid conduit. As with the previously described embodiments, the substrate 502 can support one or more RF components that make use of a fluid dielectric. The fluid conduit 508 can have any cross-sectional profile that can be conveniently manufactured using conventional LTCC techniques. For example, the fluid conduit 508 can have a circular cross-sectional profile as illustrated in FIGS. 5–7 or a square cross-sectional profile as illustrated in FIG. 8.

Regardless of the particular cross-sectional profile selected, one or more piezoelectric structures 504 can define at least a portion of an interior surface 506 lining a selected length L of the fluid conduit 508 as illustrated in FIG. 6. According to one embodiment, the piezoelectric structures 504 can be advantageously positioned so that they are disposed on at least two opposing wall portions of the fluid conduit 508 as show in FIGS. 5 and 6. In FIGS. 5 and 6, the piezoelectric structures are formed as arced members defining a portion of the interior surface 506. However, the invention is not so limited and the piezoelectric structures 504 can also be formed as opposing top and bottom walls or opposing side walls in the case of square profile conduit. In this way, the piezoelectric structures 504 can actuate on the fluid dielectric concurrently from at least two opposing sides when each is excited with an electric current. These opposing forces are illustrated in FIG. 7 by arrows. Consequently, issues of eddy currents and shears can be more effectively addressed. In particular, the opposing position of the structures decrease the potential for the piezoelectric structure to drive the particles in one direction only.

Figure 8:
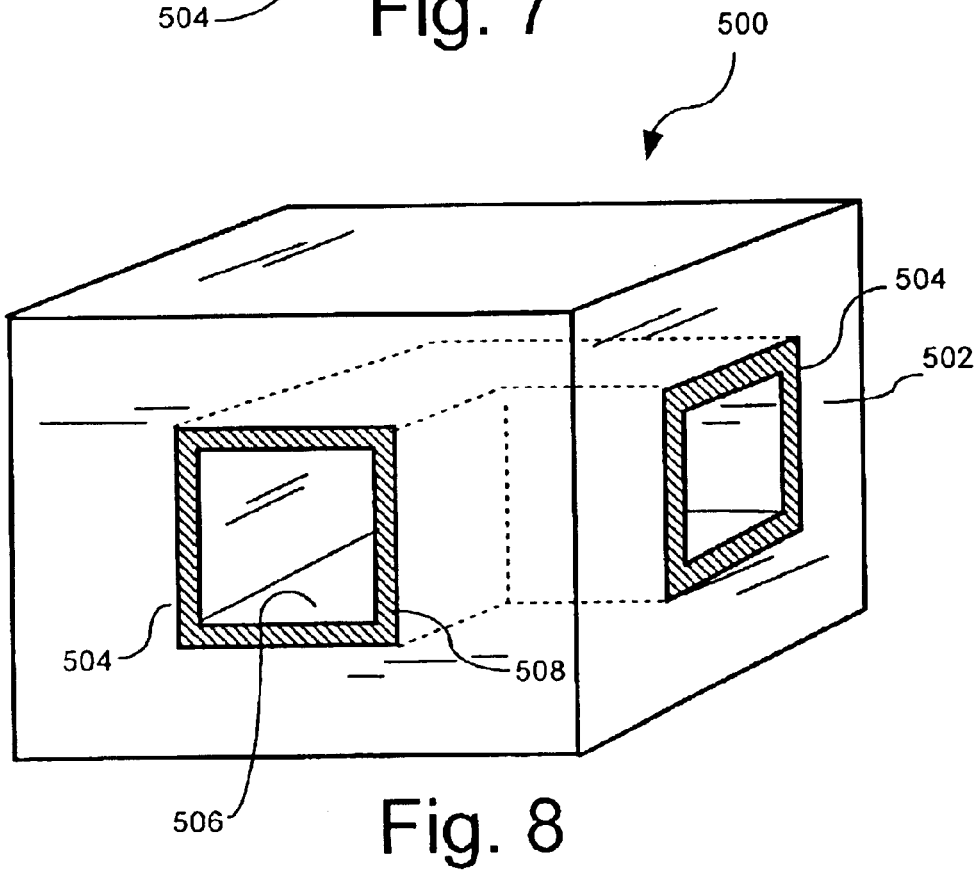
FIG. 8 is a perspective view of a further alternative structure for an integrated mixing device.
Figure 9:
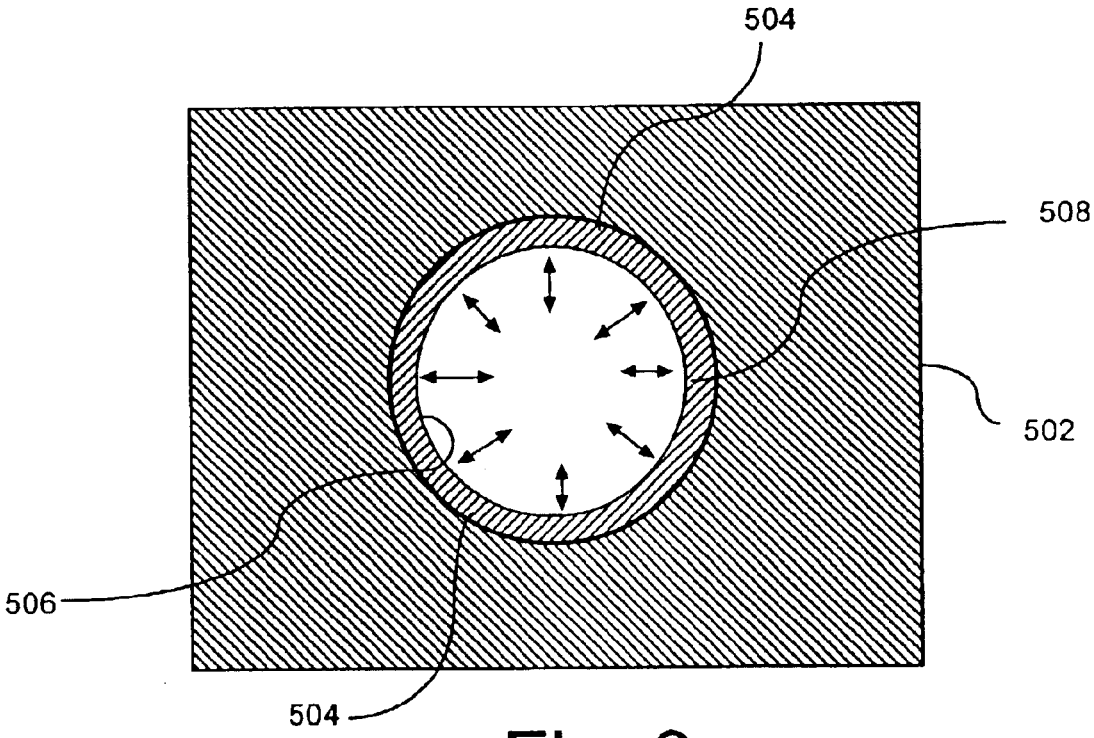
FIG. 9 is a cross-sectional view of a fluid conduit in which a piezoelectric structure extends continuously around an interior surface of the conduit.

According to a preferred embodiment illustrated in FIGS. 8 and 9, the piezoelectric structure 504 can form a substantially continuous lining within the region of the fluid conduit 508 coextensive with the selected length L. Consequently, when an excitation voltage is applied to the piezoelectric structure 504, the structure can actuate on the fluid dielectric contained within the fluid conduit from all radial directions concurrently as illustrated in FIG. 9. The arrows in FIG. 9 show the direction of force created by the piezoelectric structure. Utilizing the foregoing arrangement, the possibility of the piezoelectric actuator 504 driving the particles comprising the fluid dielectric in only one direction can be significantly reduced.

The piezoelectric structure in FIGS. 5–9 can be formed of PZT using materials and techniques similar to those described above relative to FIGS. 1–4. Partial or continuous linings as illustrated in FIGS. 5–9 can be created in LTCC using conventional layered fabrication techniques. Further, electrical contacts can be provided at opposing ends of the PZT structures in a manner similar to that previously described.

According to a preferred embodiment, the piezoelectric structure 504 can be advantageously positioned in areas where it is anticipated that the fluid dielectric will experience non-Newtonian fluid dynamics. Common fluids such as air and water tend to have a relatively constant viscosity regardless of shear rate are known as Newtonian fluids. However, many fluids, including certain fluid dielectrics, have viscosities which depend heavily on the rate at which they are sheared. Such materials are known as non-Newtonian fluids. This leads to higher velocity gradients at solid walls than would be experienced with Newtonian fluids.

In order to counteract these effects, the piezoelectric structure 504 can be advantageously positioned at locations where the fluid conduit forms a corner or significant change of direction as illustrated in FIG. 8. The placement of piezoelectric structures in corner regions will afford dynamic control of Newtonian and non-Newtonian fluidic phenomena. Fluidic dynamics examples that may effect dielectric fluids can include particle and plate slip, stress, Brownian motion, transient pool boiling, parametric instabilities, static and turbulent coagulation, static and dynamic relaxation, stress singularities, and associated Stokes flow parameters. The strategic placement of piezoelectric elements in-line and at corner regions will enable applied forces to be harmonically generated to reduce or eliminate degrading stresses, induce homogeneity, reduce coagulation, increase plate, rod, or disk slip, and reduce polymer relaxation that the dielectric fluids can experience during system operation. The effects of applied harmonics and forces on liquids have been historically documented in the literature.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

I claim:

1. A method for preventing degradation of a fluid dielectric in an RF device, comprising the steps of:

forming a substrate of said RF device from a low temperature co-fired ceramic (LTCC); and concurrently agitating said fluid dielectric from at least two opposing directions by exciting a piezoelectric material.

2. The method according to claim 1 further comprising the step of selecting said opposing directions to include substantially all directions normal to an interior surface defining a fluid conduit over a selected length of a fluid conduit.

3. The method according to claim 1 further comprising the step of selectively performing said agitating step within a conduit portion of said substrate.

4. The method according to claim 1 further comprising the step of selectively performing said agitating step at a location where non-Newtonian fluid dynamics are anticipated.

5. The method according to claim 1 further comprising the step of selectively performing said agitating step at a location where a change in a direction of fluid flow is anticipated.

6. The method according to claim 1 further comprising the step of selecting said piezoelectric material to include lead zirconate titanate (PZT).

7. The method according to claim 6 further comprising the step of bonding said PZT to said substrate.

8. The method according to claim 7 wherein said bonding step is further comprised of positioning said PZT in contact with said substrate and co-firing said substrate together with said PZT.

9. The method according to claim 6 further comprising the step of doping said PZT to enhance bonding with said substrate.

10. The method according to claim 9 further comprising the step of doping said PZT with a material selected from the group consisting of calcium lead, zirconium, oxygen, and titanium.

11. The method according to claim 10 further comprising the step of doping said PZT with a rare earth element.

12. The method according to claim 11 further comprising the step of selecting said rare earth element from the group consisting of Ruthenium, Osmium, Rhenium, Halfnium, Tantalum, and Germanium.

13. The method according to claim 9 further comprising the step of selecting said doping level to be in the range from between about 0.5 to 18 percent weight.

14. The method according to claim 6 further comprising the step of forming at least one electrical contact in said substrate coupled to said PZT for applying an exciter voltage.

15. The method according to claim 1 further comprising the step of positioning said piezoelectric material in direct contact with said fluid dielectric.

16. An RF device comprising:

a substrate formed of a low temperature co-fired ceramic (LTCC);

a cavity structure formed within said substrate;

at least one fluid dielectric contained within said cavity structure; and a piezoelectric structure for concurrently applying agitation force to said fluid dielectric in at least two opposing directions.

17. The RF device according to claim 16 wherein said opposing directions include substantially all directions normal to an interior surface defining a fluid conduit over a selected length of said fluid conduit.

18. The RF device according to claim 16 wherein said cavity structure is a fluid conduit.

19. The RF device according to claim 16 wherein said piezoelectric structure is positioned at a location where non-Newtonian fluid dynamics are anticipated to occur within said cavity structure.

20. The RF device according to claim 16 wherein said piezoelectric structure is positioned at a location where a change in a direction of fluid dielectric flow is anticipated.

21. The RF device according to claim 16 wherein said piezoelectric structure is comprised of lead zirconate titanate (PZT).

22. The RF device according to claim 21 wherein said PZT is bonded to said substrate.

23. The RF device according to claim 22 wherein said PZT and said substrate are co-fired.

24. The RF device according to claim 22 wherein said PZT is doped to enhance embedded interstitial bonding with said substrate.

25. The RF device according to claim 24 wherein said PZT is doped with a material selected from the group consisting of calcium lead, zirconium, oxygen, and titanium.

26. The RF device according to claim 25 wherein said PZT is doped with a rare earth element.

27. The RF device according to claim 26 wherein said rare earth element is selected from the group consisting of Ruthenium, Osmium, Rhenium, Halfnium, Tantalum, and Germanium.

28. The RF device according to claim 24 wherein a dopant material comprises between about 0.5 to 18 percent weight of said PZT.

29. The RF device according to claim 21 further comprising at least one electrical contact formed in said substrate and coupled to said PZT for applying an exciter voltage.

30. The RF device according to claim 29 wherein said piezoelectric structure is in direct contact with said fluid dielectric.

* * * * *